US005685230A

United States Patent [19]

Tegeler

[11] Patent Number: 5,685,230

[45] Date of Patent: Nov. 11, 1997

[54] RAIL VEHICLE

[75] Inventor: Ferdinand Tegeler, Berlin, Germany

[73] Assignee: ABB Henschel AG, Mannheim, Germany

[21] Appl. No.: 627,569

[22] Filed: Apr. 4, 1996

[30] Foreign Application Priority Data

Apr. 5, 1995 [DE] Germany ..... 195 12 631.9

[51] Int. Cl.[6] ..... B61D 17/00

[52] U.S. Cl. ..... 105/399; 105/401; 105/397

[58] Field of Search ..... 105/396, 397, 105/399, 401, 407, 409, 423; 296/178, 187, 191, 193, 203, 201, 205, 39.1; 52/204.1, 210, 578

[56] References Cited

U.S. PATENT DOCUMENTS

| | | | |
|---|---|---|---|
| 849,826 | 4/1907 | Brinckerhoff | 105/401 |
| 854,404 | 5/1907 | Christianson | 105/401 |
| 1,244,947 | 10/1917 | Brinckerhoff | 105/401 |
| 2,145,064 | 1/1939 | Thompson et al. | 105/401 |
| 2,216,025 | 9/1940 | Sheppard | 105/399 |
| 4,462,629 | 7/1984 | Todori et al. | 296/191 |
| 4,573,733 | 3/1986 | Zaydel | 296/191 |
| 4,607,877 | 8/1986 | Shelton | 296/191 |
| 4,974,900 | 12/1990 | Destefani et al. | 105/401 |

FOREIGN PATENT DOCUMENTS

| | | | |
|---|---|---|---|
| 167067 | 7/1991 | Japan | 105/397 |

*Primary Examiner*—Mark T. Le
*Attorney, Agent, or Firm*—Herbert L. Lerner; Laurence A. Greenberg

[57] ABSTRACT

A rail vehicle includes a body with side walls having a frame including supporting beams for absorbing vertical forces and longitudinal beams extending horizontally. Panelling is disposed on the inner side and the outer side of the frame and attached to the longitudinal beams. Additionally, windows are disposed in the side walls and framed by the supporting and the longitudinal beams. The supporting beams extend obliquely to the longitudinal beams and engage in the respective recesses of the longitudinal beams.

17 Claims, 1 Drawing Sheet

RAIL VEHICLE

BACKGROUND OF THE INVENTION

Field of the Invention

The invention relates to a rail vehicle, having a body with side walls that have a frame which is provided respectively on the outer side and on the inner side with panelling.

Rail vehicles, in particular for passenger transport, usually have a body which is fitted on a frame and has side walls made of steel sheet metal or light-metal sheet. Supporting beams are frequently connected to the wall sheet metal to reinforce the side walls. The side walls have recesses corresponding to any windows to be provided, into which recesses the windows together with the frames are inserted.

In order to reduce weight, it has been proposed to construct a lighter body with the same resistance to torsion and, for this purpose, to provide a frame instead of solid side walls made of sheet metal, where the frame serves as a bearing structure for panelling. In that case, the panelling can be constructed with plates of thin sheet metal or with wood or, to minimize care requirements, with plastic. The panelling is connected to the frame in each case, for example, with screws.

In addition to the required functionality of that novel production method, i.e. reliable attachment of the plates to the frame, the appearance of the rail vehicle is also important. Buyers place emphasis with regard to rail vehicles, wherever possible, on the complete concealment of all parts of the vehicle which have a holding or support function.

SUMMARY OF THE INVENTION

It is accordingly an object of the invention to provide a rail vehicle, which overcomes the hereinafore-mentioned disadvantages of the heretofore-known methods and devices of this general type and which allows assembly to be as simple as possible.

With the foregoing and other objects in view there is provided, in accordance with the invention, a rail vehicle, comprising: a body with side walls, the side walls having a frame including supporting beams for absorbing vertical forces and substantially horizontal longitudinal beams, the frame having an outer and an inner side, panelling disposed on the inner side and the outer side of the frame and attached to the longitudinal beams, windows disposed in the side walls and framed by the supporting beams and the longitudinal beams, each of the longitudinal beams having at least one recess formed therein, and the supporting beams extending obliquely to the longitudinal beams and engaging in respective the recesses of the longitudinal beams.

In accordance with an added feature of the invention, each of the longitudinal beams has a longitudinal side, the recesses in the longitudinal beams being cutouts in the longitudinal sides.

In accordance with an additional feature of the invention, respective the longitudinal beams with recesses attach to associated the supporting beams.

In accordance with another feature of the invention, the windows have a top, a bottom, and lateral sides, the windows being framed by the supporting beams on the lateral sides and by the longitudinal beams on the top and bottom.

In accordance with a further feature of the invention, each of the longitudinal beams include a bearing part and a holding part.

In accordance with again an added feature of the invention, the recess is formed in the bearing part, the supporting beams laterally engaging in respective the recesses of the bearing parts, each of the bearing parts having longitudinal sides, the recesses in the bearing parts being cutouts in one of the longitudinal sides, and the holding part being disposed on the other of the longitudinal sides and being releasably connected to the bearing part.

In accordance with again an additional feature of the invention, the rail vehicle includes retaining plates disposed on the supporting beams, the longitudinal beams resting on the retaining plates and being releasably connected to the retaining plates.

In accordance with again another feature of the invention, the retaining plates are adjustably attached to the supporting beams.

In accordance with again a further feature of the invention, the longitudinal beams extend horizontally at an adjustable height, the retaining plates defining the height.

In accordance with yet an added feature of the invention, the panelling includes outer panelling adhesively attached to the longitudinal beams. It is, thus, possible at the same time to mount the individual elements of the outer panelling in a flush manner, that is to say in a butt-jointed manner.

Furthermore, it is thereby possible to provide individual elements which have already been prefabricated, that is to say, for example, already fully painted, for installation in the final state for the outer panelling, since the assembly work yet to be carried out will have no adverse effects thereon.

This is also valid in corresponding fashion for the inner panelling, which, according to a further preferred embodiment of the invention, is attached in a force-locking and form-locking manner to the longitudinal beam so that, in this case too, no disturbing holding elements will impair the visual impression or lead to any damage during assembly.

In accordance with yet another feature of the invention, the inner panelling has a lengthwise edge and each of the longitudinal beams includes a holding part having a groove in which the lengthwise edge of the inner panelling resiliently engages.

In accordance with yet a further feature of the invention, the holding part has at least one elastic lip against which the inner panelling rests. This avoids two rigid materials being in mechanical contact directly with one another and transmitting any vibrations occurring in an undamped manner.

In accordance with still an added feature of the invention, the elastic lip is formed of rubber.

In accordance with still an additional feature of the invention, the rail vehicle includes elastic contact strips disposed between the groove in the holding part and the inner panelling. The elastic contact strips can be introduced into the undercut or groove together with the panelling or may already be provided therein before the panelling is inserted.

In accordance with still another feature of the invention, the rail vehicle includes holding screws for connecting the holding part to the bearing part.

In accordance with still a concomitant feature of the invention, the holding screws are concealed by the inner panelling.

According to a further embodiment of the invention, it has proved to be advantageous for the windows to be framed laterally by the supporting beams and at the top and bottom respectively by the longitudinal beams, thus allowing a virtually continuous window facade in the horizontal direction, which is interrupted only by the relatively few, preferably narrow supporting beams.

In this case, it can furthermore be expedient to allow the window panes to terminate flush with the outer panelling by placing the window panes on the supporting beams from the outside and attaching them thereto by elastic holding devices, for example, through the use of silicone rubber.

Other features which are considered as characteristic for the invention are set forth in the appended claims.

Although the invention is illustrated and described herein as embodied in a rail vehicle, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
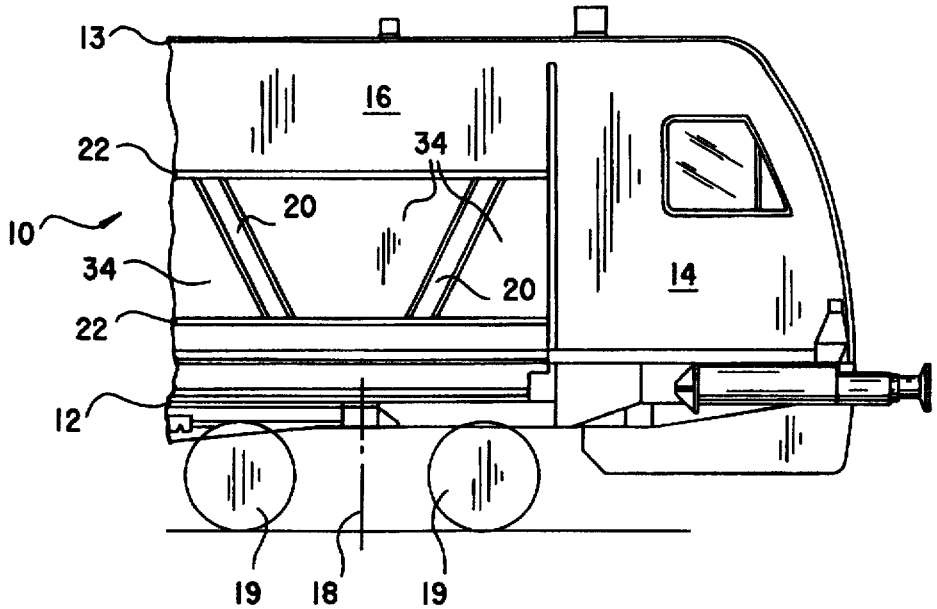
FIG. 1 is a partial, side-elevational view of a rail vehicle with a frame formed from supporting and longitudinal beams according to the invention.

Referring now to the figures of the drawings in detail and first, particularly, to FIG. 1 thereof, there is seen an end section of a rail vehicle 10, which has a body 12 with side walls 14, constructed as a frame 16, and wheel sets 18 with wheels 19 disposed in a known manner on the body 12.

The frame 16 includes an configuration of sloping supporting beams 20 and longitudinal beams 22 which run parallel to the body 12 and are respectively connected to the supporting beams 20. The frame is in turn respectively provided, as can be seen in particular in FIG. 2, on the inner side and on the outer side with panelling 24, 26 which rests closely against the frame 16 or is held by the latter. The manner in which the supporting beams 20 are connected to the body 12 or to the roof part 13 of the rail vehicle 10 is not illustrated in detail.

Figure 2:
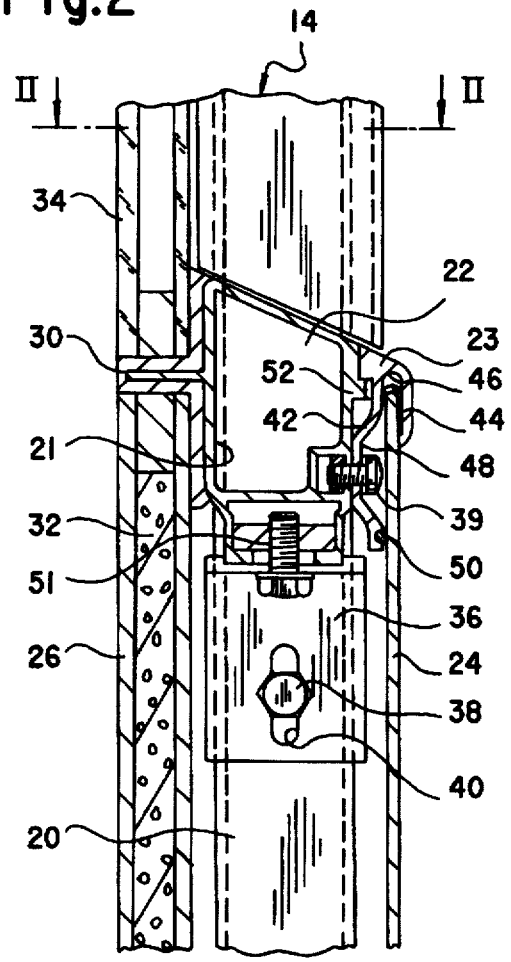
FIG. 2 is a partial, sectional view of an inserted longitudinal beam through a supporting beam.

FIG. 2 is a vertical view of a supporting beam 20 in the region of a connection to a longitudinal beam 22 which clearly illustrates a cross-section of the longitudinal beam 22 according to the invention. The longitudinal beam 22 includes two parts, a load-absorbing bearing part 21 and a holding part 23 which secures the position of the bearing part in relation to the respective supporting beam 20. The bearing part 21 is provided with a recess 28, illustrated in FIG. 3, at points of assembly with the respective supporting beam 20. The recess 28 is a cutout in the longitudinal side of the longitudinal beam 22 facing the inside of the vehicle. The longitudinal beam is attached from the outside to the respective supporting beams 20.

The supporting beam 20 is hollow like the bearing part 21 of the longitudinal beam. However, it has a rectangular cross-section, preferably with rounded longitudinal edges, whereas the bearing part 21 of the longitudinal beam 22 has a trapezoidal cross-section with a projecting web 30 or bridge formed on the surface facing outside the vehicle. The web 30 serves both to align and to attach outer panelling 26 which is placed against the surface of the bearing part 21 facing outside the vehicle and is formed from wall elements 32 and glass windows 34 which are prefabricated. It can furthermore be expedient to allow the window panes 34 to terminate flush with the outer panelling 26 by placing the window panes 34 on the supporting beams 20 and the longitudinal beams 22 from the outside and attaching them thereto by elastic holding devices, for example, through the use of silicone rubber.

The wall elements 32 are preferably plates produced in sandwich construction with a core formed from an insulating layer and a fully painted covering layer disposed at least on the surface facing outside the vehicle, e.g. a thin layer of light metal or of wood or plastic. If appropriate, both sides of the wall elements 32 can be provided with the prefabricated covering layer.

Retaining plates 36 are provided on the supporting beams 20, which are obliquely disposed relative to the horizontal, in regions of a connection with a longitudinal beam 22. The retaining plates 36 serve as a rest or support and to connect the bearing part 21 of the longitudinal beam 22. The longitudinal beams 22 are releasably connected to the retaining plates 36 via screw or bolt members 51. The retaining plates 36 are mounted on respective supporting beams 20 so as to be vertically adjustable for aligning the longitudinal beam 22 without difficulty in relation to the body 12. Holding screws 38 connect the bearing part 21 of the longitudinal beam 22 to the respective retaining plate 36. Similarly, screws 39 connect the holding part 23 to the bearing part 21. The retaining plates 36 are respectively provided with elongated bores 40 for the holding screws 38.

The holding part 23, which is connected to the bearing part 21 with the aforementioned screws 39, has an approximately U-shaped cross-section. One leg 42 of the U-shaped cross-section, namely the leg to be connected to the bearing part 21 and which is disposed towards the outer surface of the vehicle, has approximately twice the length of the other leg 44. In this case, the U-shaped cross-section of the holding part 23 forms an undercut or groove 46 for fastening the inner panelling 24, as will be described below.

As illustrated in FIG. 2, the cross-section of the longer leg 42 has a constriction 48 with a depth corresponding at least to the thickness of the screw head of the screw 39, which attaches the holding part 23 to the bearing part 21. As a result, a flat contact of the inner panelling 24 is guaranteed, which is disposed with its upper longitudinal edge in the gap of the U-shaped holding part 23 and is, thus, form-lockingly held. A form-locking connection is one which is provided by the shapes of the elements themselves, as distinguished from a force-locking or frictional connection in which the elements are connected by a force external to the elements. In order to prevent potential play within the groove 46 and to prevent the development of noise by such play, lips 50 are provided in the groove 46 and on the longer leg 42. Contact strips 52 of elastic material, for example, rubber, against which the inner panelling 24 rests also serve to prevent play and noise.

The non-illustrated lower region of the inner panelling 24 is provided with an adhesive connection, for example, using Velcro®, or a positive-locking clamping connection or adhesive bonding. Although a screw connection of the inner panelling would also be possible, the intention of the present invention is indeed to guarantee a sturdy attachment of the inner panelling 24 without the attachment device being visible.

For this purpose, the countersink configuration of the holding screws 39 for the attachment of the holding part 23 to the bearing part 21 is provided, which is achieved with the inner panelling 24 covering the screw heads.

Figure 3:
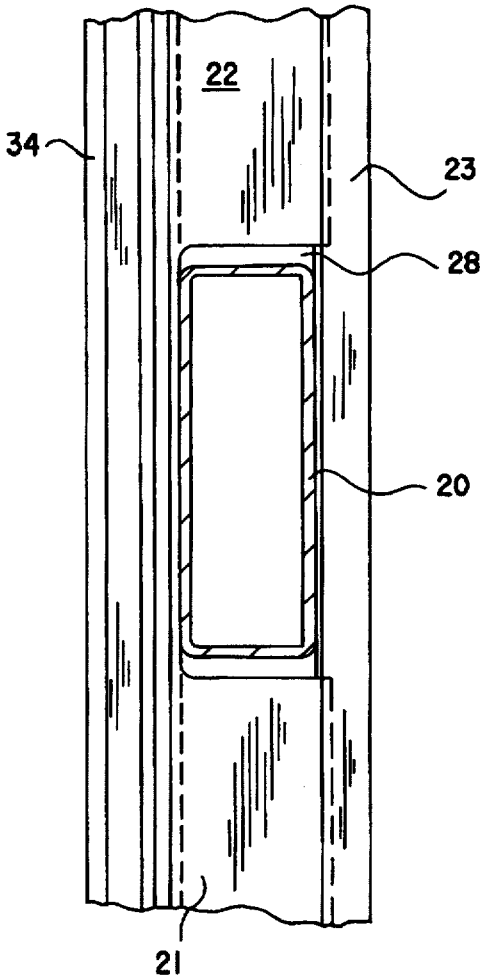
FIG. 3 is a partial, sectional view of the supporting beam inserted in the longitudinal beam, which is taken along the lines III—III of FIG. 2 in the direction of the arrows.

The longitudinal beam 22 composed of the bearing part 21 and the holding part 23 is illustrated in FIG. 3 with a plan view in the region of a connection to a supporting beam 20, which engages in the recess 28, provided for this purpose, in the longitudinal beam 22, or more specifically the bearing part 21.

I claim:

1. A rail vehicle, comprising:

a body with side walls, said side walls having a frame including supporting beams for absorbing vertical forces and substantially horizontal longitudinal beams, said frame having outer and inner sides, panelling disposed on said inner side and said outer side of said frame and attached to said longitudinal beams, windows disposed in said side walls and framed by said supporting beams and said longitudinal beams, each of said longitudinal beams having at least one recess formed therein, and said supporting beams extending obliquely to said longitudinal beams and engaging in respective said recesses of said longitudinal beams.

2. The rail vehicle according to claim 1, wherein each of said longitudinal beams has a longitudinal side, said recesses in said longitudinal beams being cutouts in said longitudinal sides.

3. The rail vehicle according to claim 1, wherein respective said longitudinal beams with recesses attach to associated said supporting beams.

4. The rail vehicle according to claim 1, wherein said windows have a top, a bottom, and lateral sides, said windows being framed by said supporting beams on said lateral sides and by said longitudinal beams on said top and bottom.

5. The rail vehicle according to claim 1, wherein each of said longitudinal beams include a bearing part and a holding part.

6. The rail vehicle according to claim 5, wherein said recess is formed in said bearing part, said supporting beams laterally engaging in respective said recesses of said bearing parts, each of said bearing parts having longitudinal sides, said recesses in said bearing parts being cutouts in one of said longitudinal sides, and said holding part being releasably connected to said bearing part via a holding screw.

7. The rail vehicle according to claim 1, including retaining plates disposed on said supporting beams, said longitudinal beams resting on said retaining plates and being releasably connected to said retaining plates via first fastening members.

8. The rail vehicle according to claim 7, wherein said retaining plates are adjustably attached to said supporting beams via a second fastening member.

9. The rail vehicle according to claim 7, wherein said longitudinal beams extend horizontally at an adjustable height, said retaining plates defining said height via a second fastening member.

10. The rail vehicle according to claim 1, wherein said panelling includes outer panelling being glued to said longitudinal beams.

11. The rail vehicle according to claim 1, wherein said panelling includes inner panelling attached to said longitudinal beams.

12. The rail vehicle according to claim 11, wherein said inner panelling has a lengthwise edge and each of said longitudinal beams includes a holding part having a groove in which said lengthwise edge of said inner panelling engages.

13. The rail vehicle according to claim 12, wherein said holding part has at least one elastic lip against which said inner panelling rests.

14. The rail vehicle according to claim 13, wherein said elastic lip is formed of rubber.

15. The rail vehicle according to claim 12, including elastic contact strips disposed between said groove in said holding part and said inner panelling.

16. The rail vehicle according to claim 5, including holding screws for connecting said holding part to said bearing part.

17. The rail vehicle according to claim 16, wherein said holding screws are concealed by said inner panelling.

* * * * *